US011117380B2

(12) United States Patent
Tamaru et al.

(10) Patent No.: US 11,117,380 B2
(45) Date of Patent: Sep. 14, 2021

(54) LIQUID EJECTION APPARATUS AND METHOD OF CONTROLLING LIQUID EJECTION APPARATUS

(71) Applicant: CANON KABUSHIKI KAISHA, Tokyo (JP)

(72) Inventors: Yuji Tamaru, Tokyo (JP); Kazumasa Matsushita, Kawasaki (JP); Hirofumi Okuhara, Tokyo (JP); Chiaki Muraoka, Kawaguchi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/720,723

(22) Filed: Dec. 19, 2019

(65) Prior Publication Data

US 2020/0207103 A1 Jul. 2, 2020

(30) Foreign Application Priority Data

Dec. 26, 2018 (JP) ..... JP2018-242988

(51) Int. Cl.
*B41J 2/175* (2006.01)

(52) U.S. Cl.
CPC ..... *B41J 2/17509* (2013.01); *B41J 2/17506* (2013.01)

(58) Field of Classification Search
CPC ..... B41J 2/17509; B41J 2/17506
See application file for complete search history.

(56) References Cited

U.S. PATENT DOCUMENTS 5,831,652 A 11/1998 Hinami et al. ..... 347/86
6,345,888 B1 2/2002 Matsumoto et al. ..... 347/86
6,402,308 B1 6/2002 Hattori et al. ..... 347/86
6,452,202 B1 * 9/2002 Eom ..... G01F 23/2921 250/574
6,505,923 B1 1/2003 Yamamoto et al. ..... 347/85
7,283,258 B1 * 10/2007 Kuno ..... B41J 2/17566 358/1.13
8,500,265 B2 8/2013 Yamakami et al. ..... 347/100
8,757,776 B2 6/2014 Yamakami et al. ..... 347/54
9,914,305 B2 3/2018 Orihara et al. ..... B41J 2/17523
10,093,105 B2 10/2018 Shimamura et al. ..... B41J 2/17553
10,112,403 B2 10/2018 Ikebe et al. ..... B41J 2/17523
(Continued)

FOREIGN PATENT DOCUMENTS

JP 2016-000505 1/2016
JP 2018-069706 5/2018

OTHER PUBLICATIONS

U.S. Appl. No. 16/804,223, filed Feb. 28, 2020.

*Primary Examiner* — Sharon Polk
(74) *Attorney, Agent, or Firm* — Venable LLP

(57) ABSTRACT

A liquid ejection apparatus includes: a liquid ejection unit; a liquid storage container including a replenishment port through which to replenish the liquid storage container with a liquid and an opening-closing member which closes and opens the replenishment port; and a notification unit configured to notify a user of information to be recognized by the user; and a control unit configured to control the notification unit. In a case where the time elapsed since the previous liquid ejection by the liquid ejection unit is a predetermined time or longer, the control unit causes the notification unit to notify the user of information on replenishment of the liquid storage container with a liquid.

19 Claims, 7 Drawing Sheets

(56) References Cited

U.S. PATENT DOCUMENTS

| | | | | |
|---|---|---|---|---|
| 10,399,346 | B2 | 9/2019 | Arai et al. | B41J 29/13 |
| 10,399,347 | B2 | 9/2019 | Miyashita et al. | B41J 2/17506 |
| 10,427,412 | B2 | 10/2019 | Okude et al. | B41J 2/17523 |
| 10,538,092 | B2 | 1/2020 | Miyashita et al. | B41J 2/17523 |
| 2009/0040254 | A1* | 2/2009 | Umeda | B41J 2/17509 347/12 |
| 2018/0207967 | A1* | 7/2018 | Horade | B41J 2/17566 |
| 2018/0281427 | A1* | 10/2018 | Shimano | B41J 2/17566 |
| 2018/0370243 | A1 | 12/2018 | Shimamura et al. | B41J 2/17509 |
| 2019/0023019 | A1 | 1/2019 | Ikebe et al. | B41J 2/17523 |
| 2019/0337296 | A1 | 11/2019 | Arai et al. | B41J 2/17509 |
| 2020/0016901 | A1* | 1/2020 | Chino | B41J 11/007 |

* cited by examiner

LIQUID EJECTION APPARATUS AND METHOD OF CONTROLLING LIQUID EJECTION APPARATUS

BACKGROUND OF THE INVENTION

Field of the Invention

The present disclosure relates to a liquid ejection apparatus that ejects a liquid supplied from a liquid storage unit and a method of controlling a liquid ejection apparatus.

Description of the Related Art

Liquid ejection apparatuses as represented by inkjet printing apparatuses have a liquid ejection head and a liquid storage container from which a liquid is supplied to the liquid ejection head, and eject the liquid from the liquid ejection head to print an image or the like. As the liquid storage container, there are a so-called cartridge type configured such that the user replaces the liquid storage container itself in a case where the amount of the liquid stored therein decreases to or below a predetermined amount, and a type configured such that the user can replenish the liquid storage container with a liquid from outside the liquid storage container in the above case. This type of liquid storage container replenishable with the liquid has a replenishment port through which to replenish the liquid storage container with a liquid. The replenishment port is normally closed with a cap or the like. In a case where the liquid storage container is replenished with a liquid, the cap is removed. Then, a bottle, for example, is inserted into the replenishment port, and the liquid is supplied from the bottle (outside).

A problem with such a liquid storage container replenishable with a liquid from outside is that in case the user forgets to close the cap for the replenishment port after replenishment, the liquid evaporates through the replenishment port, so that the concentration of the stored liquid changes. To address such a problem, Japanese Patent Laid-Open No. 2018-69706 discloses a method in which a detection unit that detects the open-closed state of a cap is provided near the cap and whether the cap is closed is detected with the detection unit. Also, Japanese Patent Laid-Open No. 2016-505 discloses a method in which a cap is made visible from outside even after a cover is closed to prevent the user from forgetting to close the cap.

SUMMARY OF THE INVENTION

The present disclosure provides a liquid ejection apparatus includes: a liquid ejection unit configured to eject a liquid; a liquid storage container including a replenishment port through which to replenish the liquid storage container with a liquid and a member which closes and opens the replenishment port, the liquid storage container being replenishable with the liquid to be supplied to the liquid ejection unit from the replenishment port; a notification unit configured to notify a user of information; and a control unit configured to control the drive unit. In a case where a time elapsed since a previous liquid ejection by the liquid ejection unit is a predetermined time or longer, the control unit causes the notification unit to notify the user of information on replenishment of the liquid storage container with a liquid.

Further features of the present invention will become apparent from the following description of exemplary embodiments with reference to the attached drawings.

DESCRIPTION OF THE EMBODIMENTS

According to the methods disclosed in Japanese Patent Laid-Open Nos. 2018-69706 and 2016-505, it is possible to suppress the evaporation of the liquid due to forgetting to close the cap on the replenishment port. However, according to the present inventors study, there are cases where evaporation of the liquid in the liquid ejection apparatus cannot be sufficiently suppressed even by closing the cap on the replenishment port. For example, the liquid evaporates through the wall of the liquid storage container, a tube connecting the liquid storage container and the liquid ejection head and a portion around the joint, a gap between the cap and the replenishment port, and so on. This may result in a rise in concentration of the liquid. Such a rise in concentration of the liquid by the evaporation is great particularly in a case where the liquid ejection apparatus is left unused for a prolonged period of time, and a desired image may fail to be formed in a case where the liquid with the raised concentration is ejected as it is from the liquid ejection head.

Liquid ejection apparatuses according to embodiments of the present disclosure will be described below. The liquid ejection apparatuses will be described in detail below with reference to the drawings.

Figure 1:
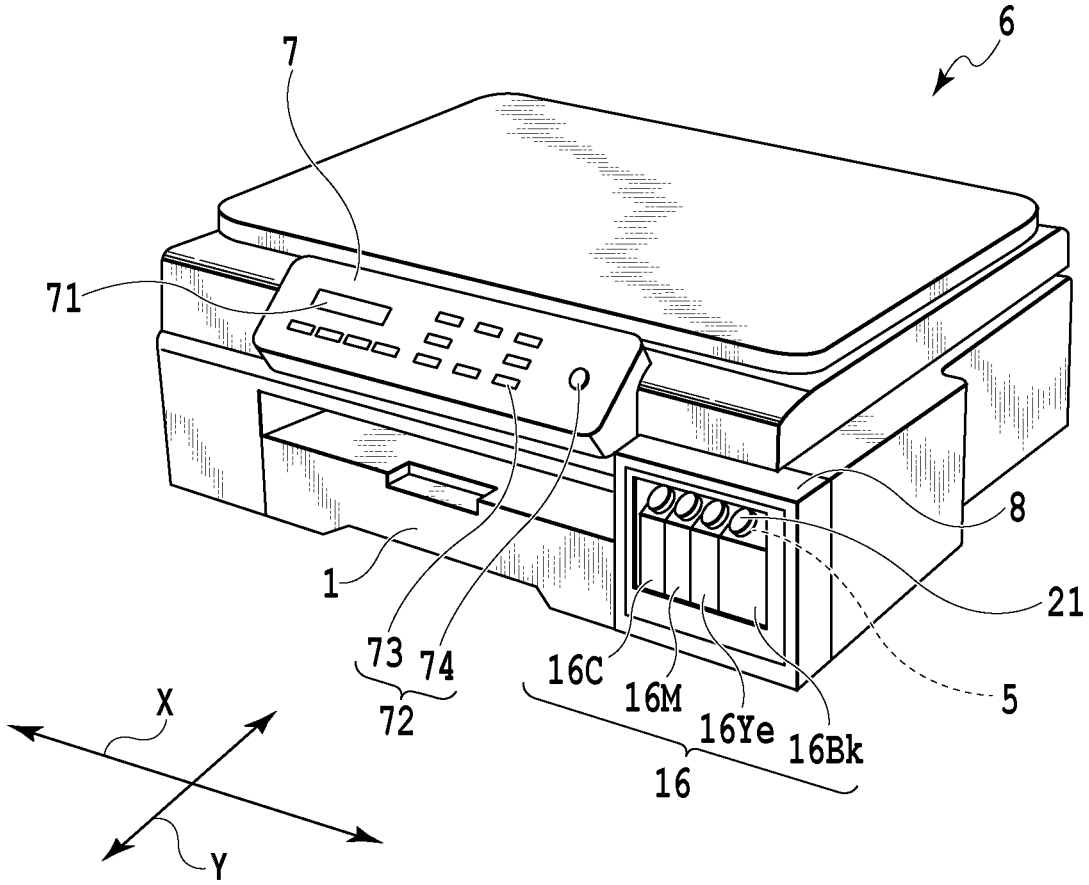
FIG. 1 is a perspective view showing a liquid ejection apparatus of the present disclosure.
Figure 2:
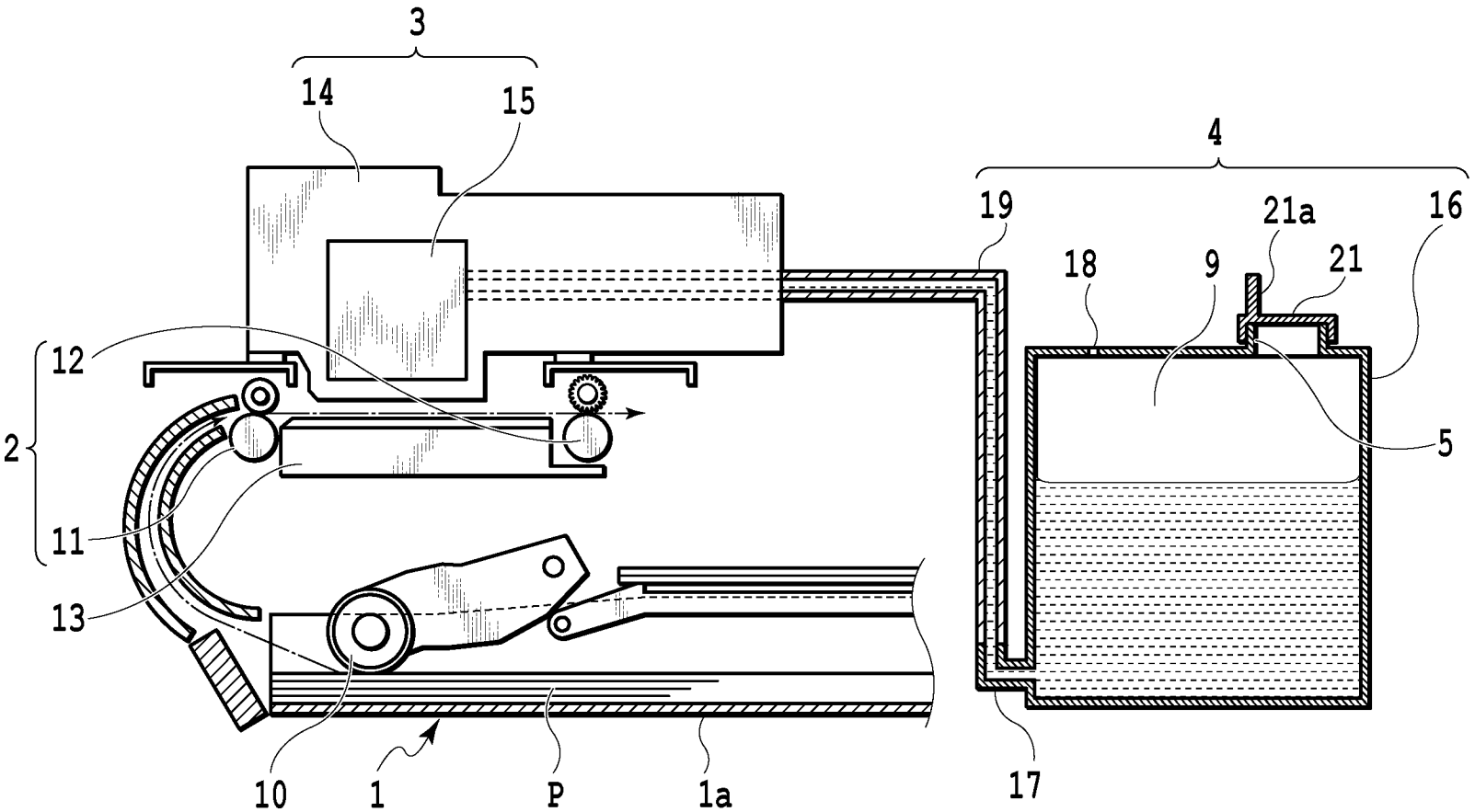
FIG. 2 is a vertical cross-sectional view schematically showing the configuration of the liquid ejection apparatus.

FIGS. 1 and 2 show an inkjet printing apparatus (hereinafter also referred to as "printing apparatus") as an example of the liquid ejection apparatus. FIG. 1 is a perspective view of a printing apparatus 6, and FIG. 2 is a vertical cross-sectional side view schematically showing the internal configuration of the printing apparatus 6. As shown in FIG. 2, the printing apparatus 6 has a first feed unit 1, a second feed unit 2, a printing unit 3, a liquid supply unit 4, and so on as its mechanism units.

The first feed unit 1 feeds print media P loaded in a print medium loading portion 1*a* to the second feed unit 2 one by one by using a feeding roller 10. The second feed unit 2 comprises a conveyance roller 11, a discharge roller 12, and so on, and conveys a print medium P fed from the first feed unit 1 through a position facing a liquid ejection head (liquid ejection unit) 15 in the printing unit 3 to a predetermined discharge portion. Note that between the conveyance roller 11 and the discharge roller 12, a platen 13 is provided which supports the print medium P conveyed by the second feed unit 2 at the position facing the printing unit 3.

The printing unit 3 comprises a carriage 14 supported on a main body portion of the printing apparatus 6, and the liquid ejection head 15 mounted on this carriage 14. Using a carriage motor 140 (see FIG. 4), the carriage 14 moves reciprocally along a main scanning direction (X direction) crossing the conveyance direction of the print medium P on the platen 13 (Y direction) (main scanning). In the present embodiment, the main scanning direction (X direction) is defined as a direction perpendicular to the conveyance direction (Y direction).

The liquid ejection head 15 has ejection units (not shown) in each of which a plurality of ejection openings for ejecting a liquid (ink) are arrayed. In each ejection unit, an ejection energy generation element (not shown) is provided for each of the plurality of ejection openings. By driving these ejection energy generation elements, ejection energy is generated, with which ink is ejected from the ejection openings to print an image or the like onto the print medium P supported on the platen 13. Note that the driving of each ejection energy generation element in the liquid ejection head 15 is controlled by a CPU 101 shown in FIG. 4.

The liquids to be ejected from the liquid ejection head 15 are supplied from liquid storage containers 16 of the liquid supply unit 4. The liquid supply unit 4 comprises the liquid storage containers 16, liquid channels 17 that guide the liquids from the respective liquid storage containers 16 toward the liquid ejection head 15, and flexible liquid supply tubes 19 coupling the respective liquid channels 17 and the liquid ejection head 15 to each other. As ink is ejected from the ejection openings in the liquid ejection head 15 by a printing operation, the negative pressure inside the liquid ejection head 15 increases. As a result, the liquids stored in liquid storage chambers 9 in the respective liquid storage containers 16 are supplied to the liquid ejection head 15 through the respective liquid channels 17 and liquid supply tubes 19. Simultaneously, the same amounts of air as the liquids supplied to the liquid ejection head 15 flow into the liquid storage containers 16 from atmosphere communication openings 18 provided in the upper sides of the liquid storage containers 16 in the vertical direction.

The printing apparatus 6 is configured as a color printer that prints a color image onto a print medium P by ejecting a plurality of types of inks differing in color. Thus, the liquid ejection head 15 is provided with a plurality of ejection units for the plurality of types of inks. In the present embodiment, the liquid ejection head 15 is provided with four ejection units that eject inks of four colors of yellow, cyan, magenta, and black, respectively. As for the liquid storage containers 16 too, four types of liquid storage containers are provided to store the inks of the four colors. FIG. 1 shows a liquid storage container 16C that stores the cyan ink, a liquid storage container 16M that stores the magenta ink, a liquid storage container 16Ye that stores the yellow ink, and a liquid storage container 16Bk that stores the black ink as the liquid storage containers 16. Note that the basic configurations of the liquid storage containers in the present embodiment are substantially the same. In a case where all liquid storage containers are described collectively in the following description, the liquid storage containers are denoted by reference numeral 16.

Figure 3:
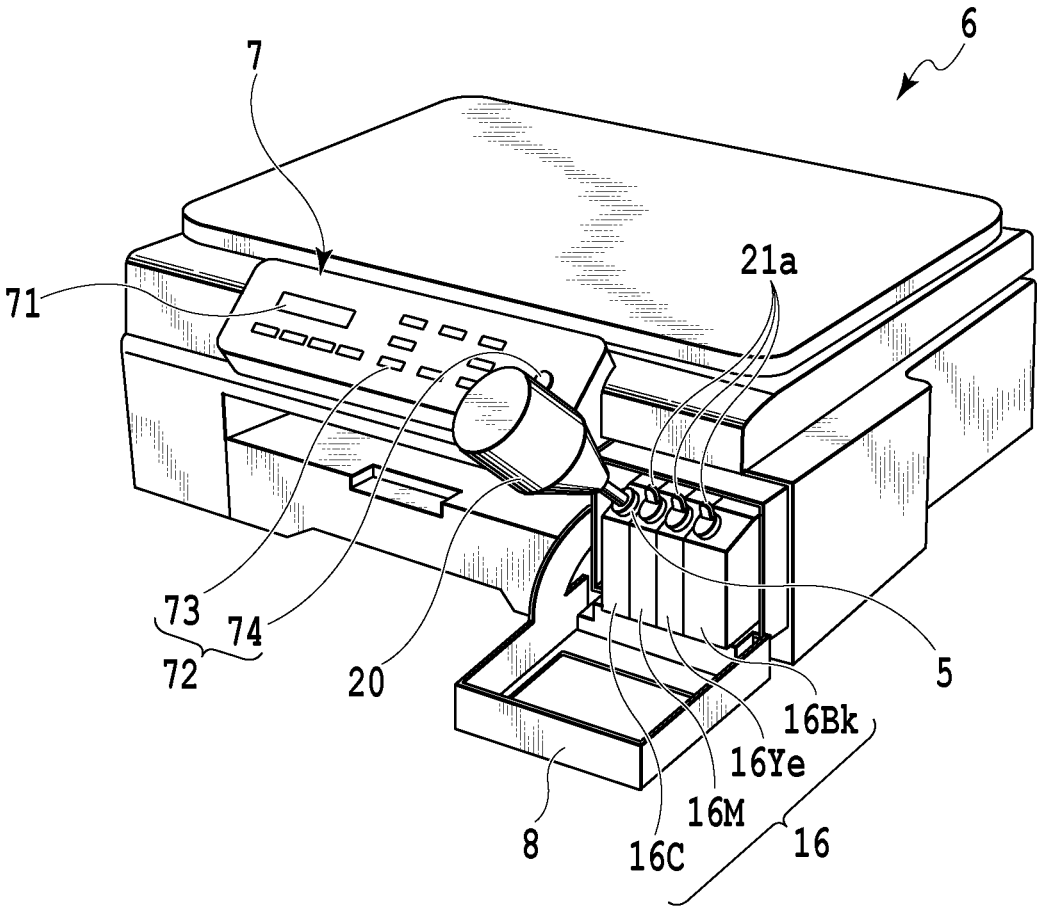
FIG. 3 is a perspective view showing how a liquid storage container is replenished with a liquid.

Each liquid storage container 16 is provided with a replenishment port 5 through which to replenish the inside (liquid storage chamber 9) with ink. While the liquid storage container is not replenished with ink, this replenishment port 5 is closed with a cap (opening-closing member) 21 in order to avoid evaporation of the ink, inclusion of foreign matters, and so on. In the case of replenishing the liquid storage chamber 9 of the liquid storage container 16 with a liquid, as shown in FIG. 3, a cover 8 provided at the front surface of the printing apparatus 6 is opened toward the front side, and the cap 21 closing the replenishment port 5 is removed to expose the replenishment port 5.

Then, an introduction nozzle of a bottle 20 is inserted into the exposed replenishment port 5. Subsequently, the body of the bottle 20 is pressed, for example, to introduce the liquid in the bottle 20 into the liquid storage container 16 from the replenishment port 5. The liquid storage container 16 is replenished with the liquid in this manner. Note that the cap 21 only needs to be configured to be attachable to the replenishment port 5 in such a manner as to close the replenishment port 5 and to be detachable from the replenishment port 5 to expose the replenishment port 5, and can employ various configurations. For example, the cap 21 shown in FIGS. 2 and 3 is provided with a grip 21*a* to facilitate operations of attaching and detaching the cap 21. Also, while the cap 21 may be configured to be completely separated from the liquid storage container 16 in the state where the cap 21 is detached from the replenishment port 5, the cap 21 can also be configured to be partly coupled to the liquid storage container 16 in the state where the cap 21 is detached from the replenishment port 5 in order to avoid being lost, for example.

The printing apparatus 6 has an operation-display unit 7 that functions as a user interface. The operation-display unit 7 includes a display unit (notification unit) 71 that notifies the user of various pieces of information to be recognized by displaying them, and an operation unit 72 having input keys 73, a power switch 74, and so on which are hardware keys. The display unit 71 shown in FIG. 1 is configured using a liquid crystal display or the like and is capable of displaying characters, geometric shapes, indicators, and so on. The display unit 71 is not limited to a liquid crystal display but can be configured using LEDs or another type of display. The pieces of information displayed on the display unit 71 include, for example, information on settings of the printing apparatus 6, information on the liquid stored in each liquid storage container 16, and so on. Further, the information on the liquid includes, for example, information on the remaining amount of the liquid stored in the liquid storage container, information instructing replenishment of the liquid, and so on. Note that the driving of the display unit 71 is controlled by the CPU 101.

Figure 6A:
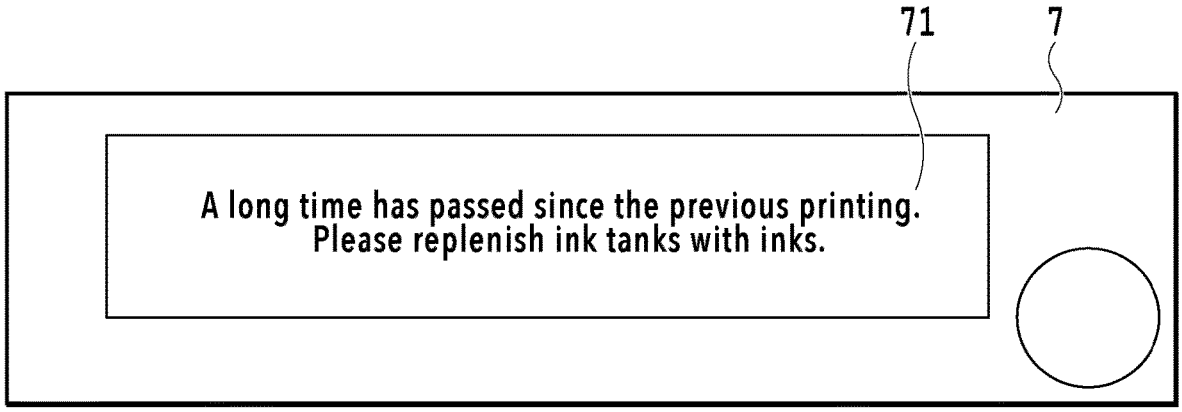
FIGS. 6A and 6B are explanatory diagrams showing an example of displays presented by an operation-display unit of the liquid ejection apparatus.
Figure 6B:
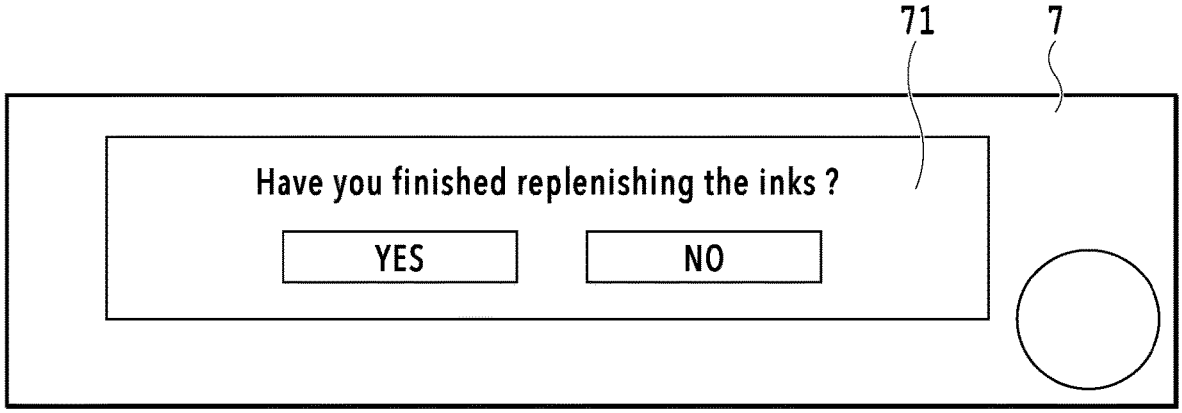

By viewing the operation-display unit 7, the user can check the remaining amount of each liquid, an instruction to replenish the liquid, and so on. For example, in a case where the remaining amount of the liquid stored in any liquid storage container 16 has decreased to or below a predetermined amount, the display unit 71 presents a display notifying the user that the liquid in the liquid storage container 16 has decreased to or below the predetermined amount and needs to be replenished. Also, in the present embodiment, in a case where a predetermined period of time has elapsed since the previous ink ejection, the display unit 71 displays an instruction prompting ink replenishment and a question asking whether the replenishment is completed as shown in FIGS. 6A and 6B, or the like. This will be specifically described later.

Note that the configuration of the operation-display unit 7 is not limited to one as the above. For example, the operation-display unit 7 may be configured only of the display unit 71. Specifically, it is also possible to cause the display unit 71 to display software keys for performing various input operations and so on as well as pieces of information to be notified to the user. In this case, the display unit 71 functions also as an operation-display unit that presents displays and is used to perform input operations and so on.

Figure 4:
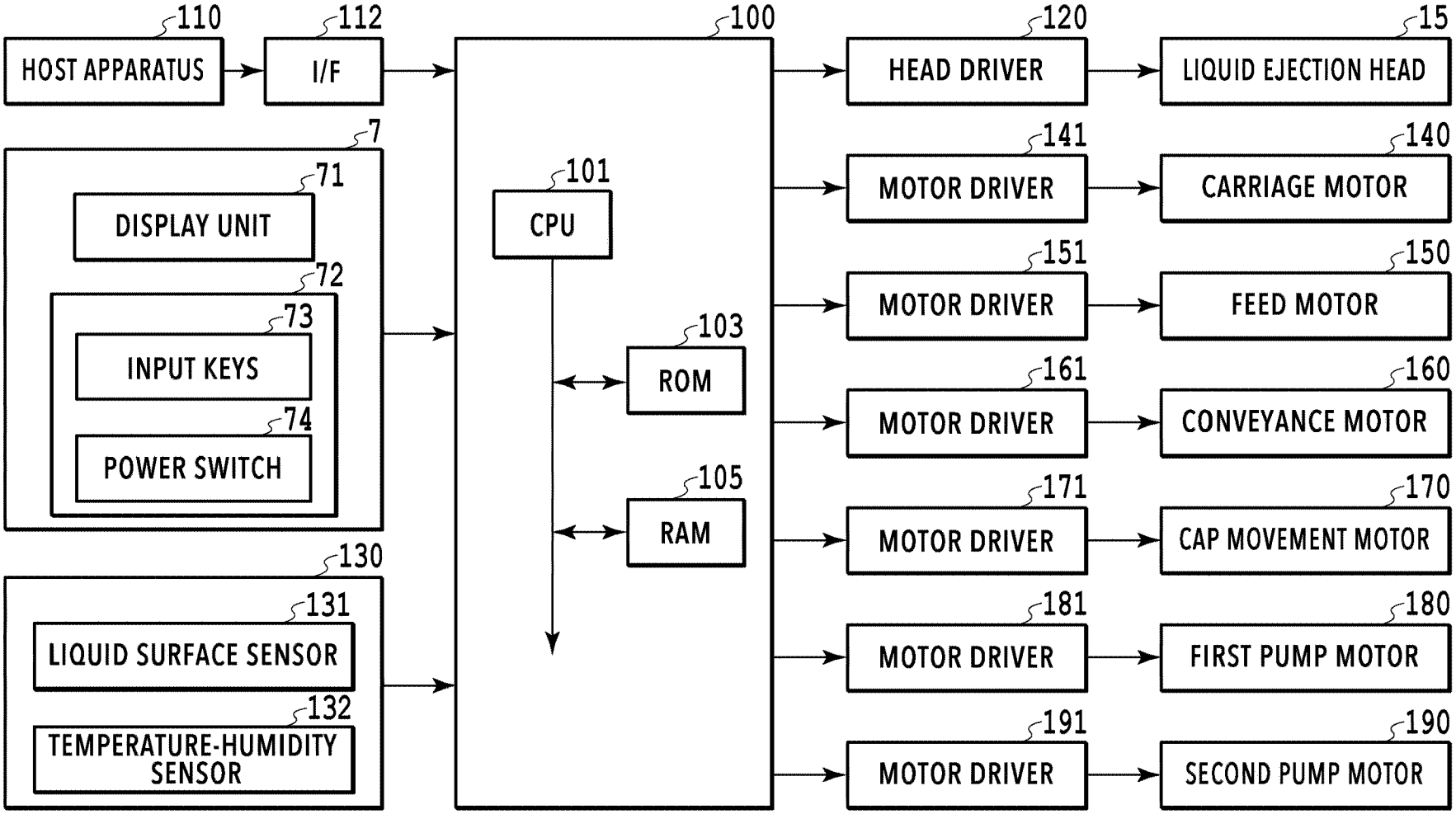
FIG. 4 is a block diagram showing a schematic configuration of a control system in the liquid ejection apparatus.

Next, a schematic configuration of a control system in the printing apparatus 6 in the present embodiment will be described with reference to a block diagram in FIG. 4. As shown in FIG. 4, a control apparatus 100 has the CPU 101, an ROM 103, an RAM 105, and so on, for example. The CPU 101 functions as a control unit configured to take overall control of the entire apparatus. The ROM 103 stores a program to be executed by the CPU 101, necessary tables, and other pieces of fixed data. In the RAM 105, areas to deploy image data, work areas, and the like are provided. The control apparatus 100 is connected via an interface (I/F) 112 to a host apparatus 110 which is a supply source of image data. The host apparatus 110 is configured using a computer comprising a printer driver that performs generation, processing, and the like of print data. However, the host apparatus is not limited to a computer, but may be configured as a reader unit that reads images or the like. Image data, commands, status signals, and so on are communicated between this host apparatus 110 and the control apparatus 100 via the interface (I/F) 112.

The display unit 71 and the operation unit 72 of the operation-display unit 7 are connected to the control apparatus 100, and the display unit 71 is controlled by the CPU 101 and displays various pieces of information as mentioned above. Also, the control apparatus 100 receives input data from the input keys 73, a power on/off command from the power switch 74, and so on.

Also, a head driver 120 that drives each the ejection energy generation element of the liquid ejection head 15, and motor drivers that drive motors provided at a plurality of positions in the printing apparatus 6 are connected to the control apparatus 100. The motor drivers include, for example, a motor driver 141 for the carriage motor 140 for performing the main scanning of the carriage 14, a motor driver 151 for a feed motor 150, a motor driver 161 for a conveyance motor 160 for rotating the conveyance roller 11 and the discharge roller 12, and so on. Further, a motor driver 171 for a cap movement motor 170, a motor driver 181 for a first pump motor 180, a motor driver 191 for a second pump motor 190, and so on are also connected to the control apparatus 100. Here, the cap movement motor 170 is a motor used as a driving source to move a cap member (not shown) that covers and opens the ejection openings of the liquid ejection head 15. The first pump motor 180 is a motor that drives a first pump (not shown) that generates negative pressure within the cap in a recovery process for maintaining or recovering the ejection performance of the ejection openings of the liquid ejection head 15. The second pump motor 190 is a motor that drives a second pump (not shown) used in a stirring operation executed in a second embodiment to be described later.

In addition to the above, a sensor group 130 including various sensors for detecting states of the printing apparatus 6 is connected to the control apparatus 100. The sensors included in this sensor group 130 include, for example, remaining liquid amount sensors 131 that detect the liquid surfaces of the liquids in the liquid storage containers 16 to detect the remaining amounts of the liquids in the liquid storage containers 16, a temperature-humidity sensor 132 that detects the temperature and humidity around the printing apparatus, and so on.

The printing apparatus 6 with the above configuration is provided with the caps 21, which are capable of closing the replenishment ports 5 of the liquid storage containers 16. However, even with each cap 21 closing the replenishment port 5, the liquid (ink) may evaporate through a portion around the replenishment port 5 and through the wall of the liquid storage container 16. The liquid may also evaporate through the wall of the liquid supply tube 19 and a portion around the joint of the liquid storage container 16 and the liquid supply tube 19. For this reason, if a prolonged period of time has elapsed since the previous (last) liquid ejection as a result of leaving the printing apparatus unused for the prolonged period of time, the evaporation of the liquid stored in the liquid storage container 16 may raise the concentration of the liquid. In a case where the next ejection operation is performed in the state where the concentration of the liquid has risen, the liquid with the high concentration is ejected onto a print medium P. This leads to a possibility that an image with higher density than necessary is formed, so that the desired image is not printed.

To solve this, in the present embodiment, in a case where a predetermined period of time has elapsed since the previous liquid ejection by the liquid ejection head 15, a display indicating information on replenishment of each liquid storage container 16 with a liquid is presented on the display unit 71. For example, a display prompting the user to replenish the liquid storage container 16 with a liquid is presented on the display unit 71. Being prompted by this display, the user replenishes the liquid storage container 16 with a liquid from the replenishment port 5. This replenishment of the liquid storage container 16 with a liquid is performed from a replenishment container such as the bottle 20 as described earlier. Since the bottle 20 is highly air tight, the liquid stored therein has been kept at a proper concentration. By replenishing the liquid storage container 16 with the liquid with the proper concentration, the liquid with the raised concentration and the replenishment liquid with the proper concentration are mixed with each other inside the liquid storage container 16, so that the concentration of the liquid in the liquid storage container 16 becomes closer to the proper concentration. Specifically, the concentration of the liquid in the liquid storage container 16 drops to be closer to the concentration before the rise by the evaporation. By ejecting this liquid from the liquid ejection head 15, it is possible to perform printing with good density.

An operation executed by the printing apparatus in the present embodiment will be described in more detail below with reference to a flowchart shown in FIG. 5. The CPU 101 executes the series of processes shown in the flowchart in FIG. 5 by deploying program code stored in the ROM 103 into the RAM 105 and executing it. Also, the symbol "S" attached to each process in FIG. 5 means a step.

In response to turning on the power switch 74 of the printing apparatus 6, the CPU 101 determines whether a print job command (liquid ejection command) has been received from the host apparatus 110 (S1). In response to receiving the print job command, the CPU 101 determines whether or not the elapsed time (standby time) from the last liquid ejection from the liquid ejection head 15 before the receipt of the print job command to the receipt of the print job command is a predetermined time or longer (S2). The standby time may be measured based on a count value obtained by a count operation started at the same time as the end of the previous liquid ejection, or measured by storing the time at which the previous liquid ejection was performed and calculating the difference between it and the time at which the next print job command was received.

If determining in the determination process in S2 that the standby time is shorter than the predetermined time, the CPU 101 does not present a display on liquid replenishment on the operation-display unit 7, but performs printing on a print medium P by ejecting a liquid(s) from the liquid ejection head 15 while conveying the print medium based on print data. On the other hand, if determining in the determination process in S2 that the standby time is the predetermined time or longer, the CPU 101 presents the display on replenishment of each liquid storage container 16 with a liquid on the display unit 71 of the operation-display unit 7 for a certain period of time (S4). In the present embodiment, the CPU 101 presents a display that prompts the user to perform liquid replenishment, such as "A long time has passed since the previous printing. Please replenish the ink tanks with inks.", as shown in FIG. 6A. It is preferable that the display contain information on the elapsed time such as "long time" as in the above example, and notify this information. The CPU 101 can also present a display for having the user answer whether the user has replenished each liquid storage container 16 with ink, after presenting the display in FIG. 6A for the certain period of time or after detecting that the user opened the cover 8. FIG. 6B shows an example of this display. In the example shown in FIG. 6B, the CPU 101 displays a question "Have you finished replenishing the inks?" and also displays software keys for entering an answer to the question ("YES" and "NO"). The CPU 101 determines whether the replenishment of each liquid storage container 16 with ink has been completed, based on the states of operation of the software keys. Specifically, if the user presses the "YES" software key as a command indicating completion of the replenishment, the CPU 101 determines the replenishment of each liquid storage container 16 with ink has been completed, and stops presenting the display in FIG. 6B on the display unit 71. The CPU 101 then proceeds to S3 and starts the printing operation.

On the other hand, if the "YES" software key remains not pressed or the "NO" software key is pressed, the CPU 101 determines that the ink replenishment has not been completed. In this case, the CPU 101 may continue presenting the display shown in FIG. 6B. Alternatively, the CPU 101 may repeat presenting the display shown in FIG. 6A and the display shown in FIG. 6B each for a certain period of time. Meanwhile, the CPU 101 suspends (prohibits) the printing operation while the ink replenishment is determined to have not been completed. If the "YES" software key is then pressed, the CPU 101 determines that the ink replenishment has been completed, and performs the printing operation in S3. Note that the configuration can be such that the answer indicating whether the ink replenishment has been completed is entered with an input key 73 of the operation-display unit 7.

As described above, in the present embodiment, before starting a printing operation, it is determined whether or not the standby time from the previous printing operation (ink ejection operation) is a predetermined time or longer, and a display prompting ink replenishment is presented prior to the printing operation if the standby time is the predetermined time or longer. By having the user recognize information on the liquids stored in the liquid storage containers in this manner, the inks whose concentrations have risen excessively due to evaporation are prevented from being ejected as they are from the liquid ejection head 15. In other words, the liquids to be ejected from the liquid ejection head are rendered into a proper state.

Note that while the predetermined time compared with the standby time in S2 is dependent on conditions such as the type of each liquid, the configuration of each liquid storage container, the temperature and humidity of the space where the liquid storage container is present, it is preferably 30 days or longer. Further, depending on these conditions, it is preferable to set the predetermined time at 100 days or longer or 500 days or longer. Meanwhile, in a case where the volume of the liquid in each liquid storage container is decreased by 10% or more by the evaporation of the liquid, the impact of the decrease on a printed image is great. Thus, the time taken by the volume of the liquid to decrease by 10% or more can be determined as the predetermined time. To further reduce the impact on the image, the time taken by the volume of the liquid to decrease by 7% or more may be determined as the predetermined time.

In the above description, an example has been discussed in which a display prompting replenishment of each liquid storage container 16 with the liquid to be used for image formation (e.g., ink) is presented (that is, a notification prompting replenishment of the liquid storage container 16 with the same type of liquid is presented). However, the liquid with which to replenish the liquid storage container 16 does not have to be the same type of liquid as the liquid for printing to be ejected from the liquid ejection head 15. For example, in a case where the liquid for printing is an ink, in particularly, an aqueous ink, a display prompting replenishment of the liquid storage container 16 with water may be presented. By replenishing the liquid storage container 16 with water, the liquid in the liquid storage container 16, whose concentration has risen due to evaporation, is diluted with the water, so that the concentration is brought closer to the proper concentration before the evaporation. As a result, an image to be formed will have proper density. Also, the liquid for replenishment different from the liquid for printing is not limited to water. A liquid containing a color material can be used as the liquid for replenishment. Note that in the case of replenishing the liquid storage container 16 with a liquid to dilute the liquid with the raised concentration, the liquid for replenishment containing a color material is preferably one having a similar hue to the hue of the liquid for printing and having a lower concentration than the concentration of the liquid for printing. As described above, as the information on replenishment of the liquid storage container with a liquid, information on the type of liquid with which to replenish the liquid storage container is preferably notified by the notification unit. The information on the type of liquid includes one specifying the type of liquid, in which case a message "Please replenish each liquid storage container with water." may be presented, for example. Alternatively, information on the concentration of the liquid in the liquid storage container is preferably notified by the notification unit. For example, a message "The concentration of the ink in each ink tank has risen." may be notified by the notification unit. Be being notified of the rise in concentration, the user is prompted to replenish a liquid. In other words, notifying the rise in concentration also corresponds to notifying the information on replenishment of the liquid storage container with a liquid.

The process of determining whether the standby time has reached or exceeded the predetermined time can be executed on occasions other than the receipt of a print job command. For example, in response to turning on the power of the printing apparatus 6, whether the time from the previous liquid ejection to this power-on (standby time) has reached or exceeded the predetermined time may be determined. Executing the above determination process in response to turning on the power makes the process from receiving a print job command to performing a printing operation (liquid ejection) smooth as compared to the case where the display prompting liquid replenishment is presented on the operation-display unit 7 after receiving a print command as in the flowchart in FIG. 5. Specifically, the user can recognize whether the printing apparatus needs liquid replenished when (immediately after) the power is turned on, and if the printing apparatus needs liquid replenishment, the user can perform a liquid replenishment operation in advance for a printing operation to be performed later. This enables the user to proceed to the printing operation smoothly as compared to the case where the user finds out that the printing apparatus needs replenishment when printing needs to be performed.

Second Embodiment

Next, a second embodiment of the present disclosure will be described. In the above first embodiment, a display on liquid replenishment is presented depending on the result of the determination of whether the standby time has reached or exceeded a predetermined time. In the second embodiment, on the other hand, a display on liquid replenishment is presented with the remaining amount of the liquid in each liquid storage container 16 taken into account as well as the standby time by taking into account the fact that the impact of the evaporation of the liquid stored in the liquid storage container 16 on its concentration varies depending on the remaining amount of the liquid in the liquid storage container 16. Specifically, the impact of the evaporation of the liquid on its concentration is small in a state where the remaining amount of the liquid in the liquid storage container 16 is large, and is large in a state where the remaining amount of the liquid is small. Thus, in the second embodiment, a display on liquid replenishment is presented on the display unit 71 in a case where the remaining amount of the liquid in any liquid storage container 16 has decreased to or below a predetermined amount.

Figure 7:
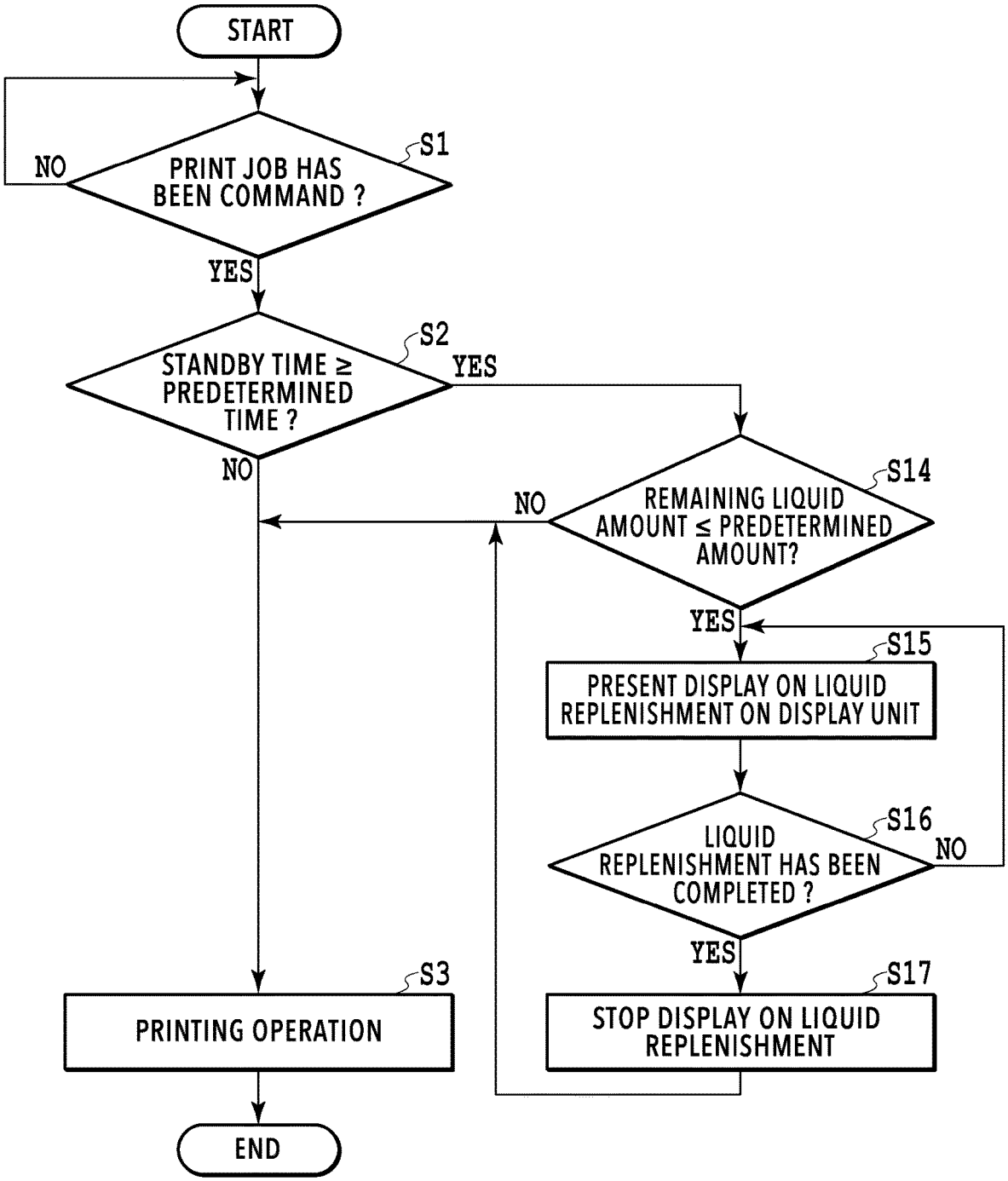
FIG. 7 is a flowchart showing the operation of a liquid ejection apparatus in a second embodiment.

An operation executed by a printing apparatus 6 in the second embodiment will be more specifically described below with reference to a flowchart in FIG. 7. Note that in the second embodiment too, the printing apparatus 6 likewise has the configurations in FIGS. 1 to 4, and the control operation shown in the flowchart in FIG. 7 is executed by the CPU 101.

In the second embodiment too, in response to turning on the power of the printing apparatus 6, the CPU 101 performs a process of determining whether or not a print job command has been received (S1) and a process of determining whether or not the standby time is a predetermined time or longer (S2), as in the first embodiment. If determining in S2 that the standby time is shorter than the predetermined time, the CPU 101 executes a printing operation (S3).

On the other hand, if determining in S2 that the standby time is the predetermined time or longer, the CPU 101 determines whether or not the remaining amount of the liquid in any liquid storage container 16 (the amount of the liquid stored in any liquid storage container 16) is a predetermined amount or smaller (S14). If determining that the remaining amount of the liquid in each liquid storage container 16 is larger than the predetermined amount, the CPU 101 executes the printing operation (a liquid ejection operation and an operation of conveying a print medium P) (S3).

On the other hand, if determining in the determination operation in S14 that the remaining amount of the liquid in any liquid storage container 16 is the predetermined amount or smaller, the CPU 101 presents a display on liquid replenishment on the display unit 71 of the operation-display unit 7 (S15). Specifically, as in the first embodiment, the CPU 101 presents a display prompting the user to replenish the liquid storage container 16 with a liquid (see FIG. 6A). Then in S16, the CPU 101 performs a process of determining whether an operation of replenishing the liquid storage container 16 with a liquid has been completed (S16). Here, if determining that the liquid replenishment has been completed, the CPU 101 stops the operation of presenting the display on the operation-display unit 7 (S17) and proceeds to S3, in which the CPU 101 executes the printing operation.

As described above, in the second embodiment, a display prompting liquid replenishment is presented only in the case where the standby time is the predetermined time or longer and the amount of the liquid stored in any liquid storage container 16 is smaller than the predetermined amount or smaller, that is, the concentration of the liquid has been greatly affected. In this way, even in the case where the standby time has reached or exceeded the predetermined time, the user will not be prompted to perform liquid replenishment by a display on the display unit 71 if the printing apparatus 6 is in a state where the impact on the liquid concentration is small, that is, a relatively large amount of liquid is stored in each liquid storage container 16. This enhances the efficiency of the liquid replenishment operation by the user, and thus enhances the user-friendliness of the printing apparatus. Note that in the present embodiment, the remaining amount of the liquid in each liquid storage container 16 is detected by the corresponding remaining liquid amount sensor 131. However, the remaining amount of the liquid in each liquid storage container 16 can also be calculated by the CPU 101 based on the amount of liquid with which the liquid storage container 16 was replenished in the previous time and the amount of liquid ejected (the number of times a liquid ejection operation has been performed by the liquid ejection head 15) since the previous liquid replenishment. Alternatively, it is possible to employ a method in the user visually checks the remaining amount of the liquid and enters the checked remaining amount into the CPU 101. Still alternatively, a sensor may be disposed in the liquid storage container 16 or in a channel linked to the liquid storage container 16, and the remaining amount of the liquid may be detected using the sensor.

The impact of the evaporation on the change in liquid concentration is great in a case where the remaining amount of the liquid in the liquid storage container 16 is 50% or smaller of the storable liquid amount in the liquid storage container 16, and is greater in a case where the remaining amount is 30% or smaller or 20% or smaller of the storable liquid amount. Thus, the above-mentioned predetermined amount is preferably set at 50% or smaller, 30% or smaller, or 20% or smaller of the storable liquid amount. Note that the storable liquid amount refers to the maximum amount of liquid which the liquid storage container can store. However, in a case where, for example, the liquid storage container 16 has a scale mark indicating a reference liquid amount up to which to replenish the liquid storage container 16, the storable liquid amount can be the liquid amount in the state where the liquid storage container 16 is filled with a liquid up to the scale mark (the top scale mark in a case where there are a plurality of scale marks).

The user can determine the amount of the liquid with which to replenish the liquid storage container 16 as appropriate. However, the amount of the replenishment liquid to be supplied by the user may be displayed on the operation-display unit 7. This can improve the user-friendliness. The amount of the replenishment liquid to be supplied can be figured out by estimating the amount of the evaporated liquid based on the standby time. The method of estimating the amount of the evaporated liquid includes, for example, a method in which a table of actual measurement values of evaporated amounts corresponding to standby times is generated and stored in the RAM 105 or the like in advance, and the standby time is entered to read out the corresponding evaporated amount. Alternatively, a function that calculates an evaporated amount based on a standby time and other parameters may be set and the evaporated amount may be obtained based on the function. In this case, for example, the temperature and humidity detected by the temperature-humidity sensor 132 or the like can be used as the parameters besides the standby time.

By obtaining the evaporated amount as described above, the amount of the replenishment liquid to be supplied can be displayed on the operation-display unit 7. In this case, the obtained evaporated amount may be simply displayed as the amount of the replenishment liquid to be supplied, or an amount of liquid larger than the evaporated amount may be displayed as the amount of the replenishment liquid to be supplied. In particular, in the case of using water as the replenishment liquid to be supplied, it is preferable to simply display the evaporated amount as the amount to be supplied. On the other hand, in the case of replenishing the liquid storage container 16 with the liquid to be ejected from the liquid ejection head 15, i.e., the liquid for printing (ink), it is preferable to display an amount larger than the evaporated amount as the amount of the replenishment liquid to be supplied. By displaying the amount of the replenishment liquid to be supplied, it is possible to replenish the liquid storage container 16 with the appropriate amount of the liquid and thus prevent the liquid from overflowing from the liquid storage container 16. Also, in the case of using water as the replenishment liquid, supplying water more than necessary may excessively lower the concentration of the liquid, but displaying the amount of the replenishment liquid to be supplied can prevent it.

Note that as for the method of displaying the amount of the replenishment liquid to be supplied to the liquid storage container 16, a numerical value can be displayed as the liquid amount to be supplied on the display unit 71. Alternatively, the liquid amount to be supplied can be displayed in a stepwise manner by using the display unit 71 or LEDs. Further, by displaying the liquid amount detected by the remaining liquid amount sensor 131 on an indicator on the display unit 71, the user can perform liquid replenishment while checking the state of the liquid replenishment with the indicator. This further improves the user-friendliness.

OTHER EMBODIMENTS

In a case where the power of any of the above printing apparatuses 6 is turned off, the standby time until the next use of the printing apparatus 6 (the next liquid ejection from the liquid ejection head) may be expected to be long. Thus, instead of immediately turning off the power in response to an operation of turning off the power, a display prompting replenishment of each liquid storage container 16 with a liquid may be presented on the operation-display unit 7. For example, in response to an operation of turning off the power, a display having the user select whether the standby time will be long may be presented, and a notification prompting liquid replenishment may be presented on the operation-display unit 7 in a case where the user selects an answer indicating that the standby time is expected to be long. Also, the display prompting replenishment includes, for example, a display indicating that liquid replenishment may be necessary beforehand for the next printing operation, a display prompting preparation of a replenishment tank for liquid replenishment for the next printing operation, and the like. Such a display is particularly effective in a case where the amount of the liquid stored in the liquid storage container 16 is small, that is, in a case where evaporation greatly affects the change in concentration of the liquid.

Meanwhile, the display on liquid replenishment can be presented also in situations other than the situation where a standby time longer than or equal to a predetermined time has elapsed since the previous liquid ejection. For example, in a case where the amount of the liquid stored in any liquid storage container 16 has decreased to or below a predetermined amount, a display notifying the user that liquid replenishment is necessary may be presented regardless of whether or not the standby time is the predetermined time or longer.

Also, in the case where the standby time of the printing apparatus 6 is long, an operation other than presenting a display, e.g., an operation of stirring the liquids in the printing apparatus 6 or the like may be performed around the time when the display on replenishment of each liquid storage container 16 with a liquid is presented on the operation-display unit 7. As mentioned earlier, in the case where the standby time is long, the concentration of the liquid in each liquid storage container 16 has risen. In this state, the concentration of the liquid in portions other than the liquid storage container 16, i.e., the liquid ejection head 15 and the liquid supply tube 19 has risen as well. This may affect the density of an image to be printed. For this reason, before or after presenting the display on the operation-display unit 7, it is effective to perform a stirring operation for making the concentration of the liquid uniform across the liquid storage container 16, the liquid supply tube 19, and the liquid ejection head 15.

The stirring operation may be performed as follows, for example. Firstly, the liquid stored in the liquid ejection head 15 is sent to the liquid storage container 16 through the liquid supply tube 19. Then, the liquid sent to the liquid storage container 16 is sent back to the liquid ejection head 15 through the liquid supply tube 19. In this way, the concentration of the liquid supplied across the entire printing apparatus 6 is made uniform. In particular, performing this stirring operation after replenishing the liquid storage container 16 with a liquid is preferable since it makes the concentration uniform across the entire apparatus. Note that the CPU 101 performs this stirring operation by rotating the second pump motor 190 provided for the liquid supply tube 19 in the forward and reverse directions.

Also, a so-called suction recovery operation and preliminary ejection operation and so on can be performed around the time when the display on liquid replenishment is presented. The suction recovery operation is an operation of forcibly sucking the liquid from the ejection openings of the liquid ejection head 15. The preliminary ejection operation is an operation of ejecting the liquid from the liquid ejection head not for the purpose of printing. With these operations, the liquid with a high concentration present in the liquid ejection head 15 is ejected. Hence, it is possible to maintain and recover the ejection performance of the liquid ejection head and also make the liquid concentration uniform in the apparatus.

Meanwhile, the shape and type of the bottle 20 storing a liquid with which to replenish the liquid storage container are not particularly limited. It suffices that a liquid stored in a usual liquid replenishment bottle is used in the case of using the liquid for printing (ink) to lower the liquid concentration. A liquid replenishment bottle usually has a configuration that prevents a change in concentration of the liquid therein. Thus, for replenishment, there is no need to be concerned about a rise in concentration of the liquid inside the bottle. Nonetheless, it is preferable to replenish the liquid storage container with the liquid stored in an unopened bottle. Also, in the case of using water as the replenishment liquid, it is preferable that the replenishment bottle 20 storing water have a different exterior (e.g., shape and/or design) from that of a replenishment bottle storing the liquid (ink) in order to prevent the wrong liquid from being introduced.

Also, in the above description, the notification unit configured to present a notification on liquid replenishment has been described by taking the operation-display unit 7 with the display unit 71 as an example. However, the unit configured to present a display on replenishment of each liquid storage container 16 with a liquid is not limited to the ones described in the above embodiments. For example, a lamp may be provided on or near each liquid storage container 16, and the lamp corresponding to the liquid storage container 16 for the replenishment target color may be turned on. In this case, the lamp functions as the notification unit configured to present a notification on liquid replenishment. Further, the notification unit is not limited to one configured to present a visual notification to the user. A sound output unit configured to present a sound notification can be used instead.

Figure 5:
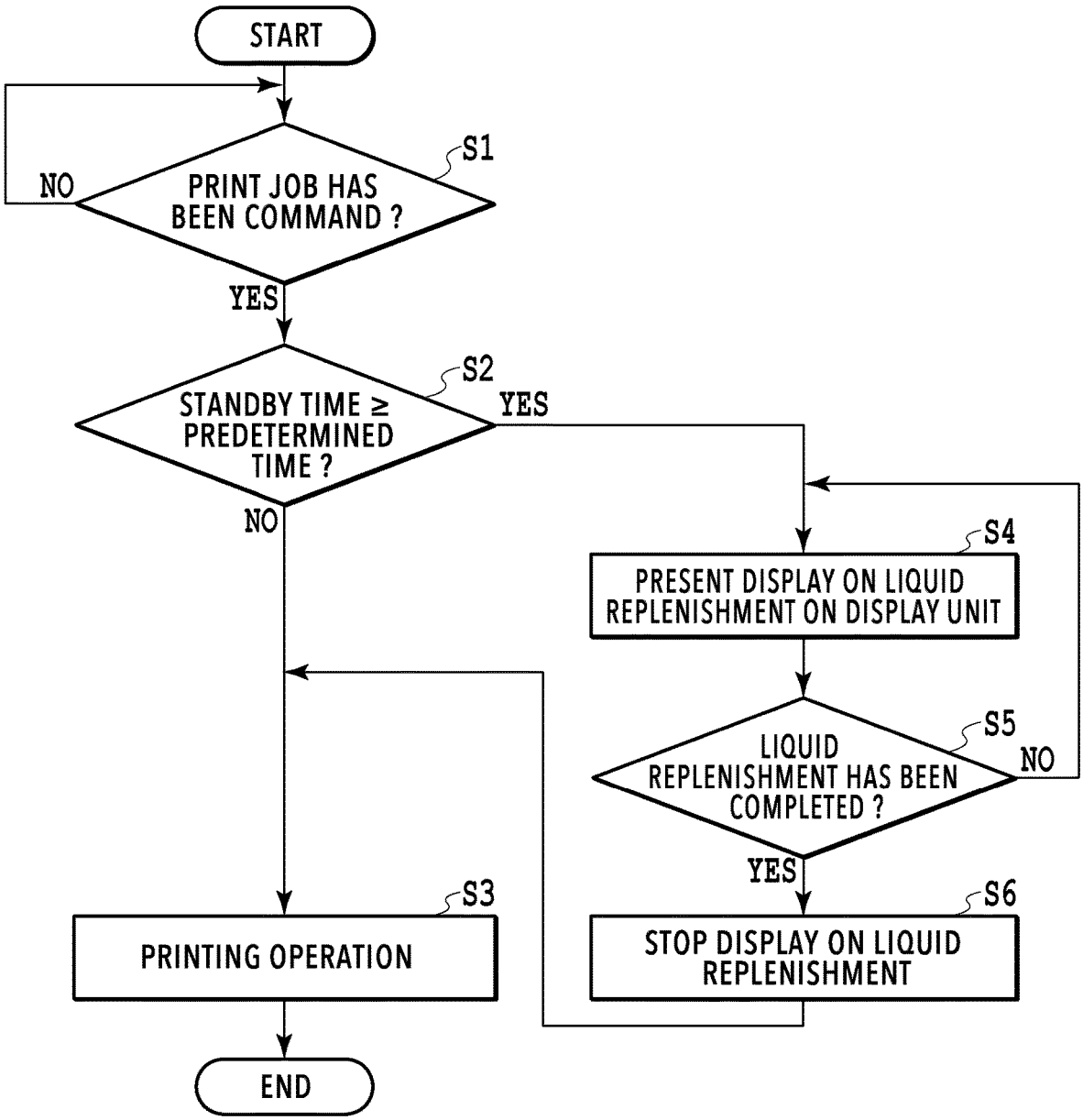
FIG. 5 is a flowchart showing the operation of a liquid ejection apparatus in a first embodiment.

Also, the functions of some or all of the processes in FIGS. 5 and 7 in the above embodiments, which are executed with a CPU, may be implemented with hardware such as an ASIC or an electronic circuit.

As the liquid ejection apparatus of the present disclosure, for example, a so-called serial-type inkjet printing apparatus can be used which performs printing while moving its liquid ejection head relative to a print medium P, as mentioned above. Besides this, the present disclosure is applicable to a so-called full line-type inkjet printing apparatus which uses a liquid ejection head with ejection openings arrayed over a length corresponding to the entire width of a print medium P. Also, the number of liquid ejection heads used is not particularly limited. It is possible to use as many liquid ejection heads and liquid storage containers as the number of ink colors used in the printing apparatus.

Further, the present disclosure is applicable not only to liquid ejection apparatuses with liquid storage containers having a replenishment port for liquid replenishment, but also to liquid ejection apparatuses with cartridge-type liquid storage containers. In this case, in a case where the concentration of the liquid in a liquid storage container has risen to or above a predetermined concentration, it is possible to present a notification prompting replacement of the cartridge. This also makes it possible to prevent ejection of the liquid with the raised concentration. Note that it is possible to use a concentration sensor such as a publicly known liquid concentration sensor that optically or electrically detects the concentration of a liquid. However, the present disclosure is more effective in the case where it is applied to a liquid ejection apparatus with liquid storage containers having a replenishment port for liquid replenishment, which is affected more greatly by liquid evaporation.

Further, the present disclosure is applicable not only to inkjet printing apparatuses that perform printing by ejecting ink but to all liquid ejection apparatuses configured to eject a liquid stored in a liquid storage container from a liquid ejection head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-242988 filed Dec. 26, 2018, which is hereby incorporated by reference wherein in its entirety.

What is claimed is:

1. A liquid ejection apparatus comprising:

a liquid ejection unit configured to eject a liquid;

a liquid storage container comprising a replenishment port through which to replenish the liquid storage container with a liquid and a member which closes and opens the replenishment port, the liquid storage container being replenishable with the liquid to be supplied to the liquid ejection unit from the replenishment port;

a notification unit configured to notify a user of information; and a control unit configured to control the notification unit, wherein in a case where a time elapsed since a previous liquid ejection by the liquid ejection unit is a predetermined time or longer, the control unit causes the notification unit to notify the user of information on replenishment of the liquid storage container with a liquid, wherein the information on replenishment of the liquid storage container with a liquid is information on a concentration of the liquid in the liquid storage container.

2. The liquid ejection apparatus according to claim 1, wherein the control unit causes the notification unit to notify the user of information prompting replenishment of the liquid storage container with a liquid as the information on replenishment of the liquid storage container with a liquid.

3. The liquid ejection apparatus according to claim 1, wherein the control unit causes the notification unit to notify the user of information on the elapsed time as the information on replenishment of the liquid storage container with a liquid.

4. The liquid ejection apparatus according to claim 1, wherein the control unit further causes the notification unit to also notify the user of information on a type of liquid with which to replenish the liquid storage container as the information on replenishment of the liquid storage container with a liquid.

5. The liquid ejection apparatus according to claim 4, wherein the control unit causes the notification unit to notify the user of information prompting replenishment of the liquid storage container with a same type of liquid as the liquid to be ejected from the liquid ejection unit.

6. The liquid ejection apparatus according to claim 4, wherein the control unit causes the notification unit to notify the user of information prompting replenishment of the liquid storage container with water.

7. The liquid ejection apparatus according to claim 1, wherein the control unit causes the notification unit to notify the user of the information on replenishment of the liquid storage container with a liquid in a case where the elapsed time is the predetermined time or longer and an amount of the liquid stored in the liquid storage container is a predetermined amount or smaller.

8. The liquid ejection apparatus according to claim 1, wherein the control unit causes the notification unit to notify the user of information on an amount of a liquid with which to replenish the liquid storage container.

9. The liquid ejection apparatus according to claim 1, wherein the control unit causes the notification unit to notify the user of the information on replenishment of the liquid storage container with a liquid in a case where a power of the liquid ejection apparatus is to be turned off.

10. The liquid ejection apparatus according to claim 1, wherein the control unit causes the notification unit to notify the user of information prompting replenishment of the liquid storage container with a liquid, determines whether the replenishment of the liquid storage container with the liquid has been completed, and executes a printing operation with the liquid ejection unit in a case where the control unit determines that the replenishment of the liquid storage container with the liquid has been completed.

11. The liquid ejection apparatus according to claim 10, wherein the control unit suspends the printing operation with the liquid ejection unit in a case where the control unit determines that the replenishment of the liquid storage container with the liquid has not been completed.

12. The liquid ejection apparatus according to claim 10, wherein the control unit determines that the replenishment of the liquid storage container with the liquid has been completed in a case where a command indicating completion of the replenishment inputted by the user is received.

13. A method of controlling a liquid ejection apparatus comprising a liquid ejection unit configured to eject a liquid, a liquid storage container comprising a replenishment port through which to replenish the liquid storage container with a liquid and a member which closes and opens the replenishment port, the liquid storage container being replenishable with the liquid to be supplied to the liquid ejection unit from the replenishment port, and a notification unit configured to notify a user of information, the method comprising:

in a case where a time elapsed since a previous liquid ejection by the liquid ejection unit is a predetermined time or longer, performing control to cause the notification unit to notify the user of information on replenishment of the liquid storage container with a liquid, wherein the information on replenishment of the liquid storage container with a liquid is information on a concentration of the liquid in the liquid storage container.

14. The method of controlling a liquid ejection apparatus according to claim 13, wherein the notification unit is caused to notify the user of information prompting replenishment of the liquid storage container with a liquid as the information on replenishment of the liquid storage container with a liquid.

15. The method of controlling a liquid ejection apparatus according to claim 13, wherein the notification unit is caused to notify the user of information on the elapsed time as the information on replenishment of the liquid storage container with a liquid.

16. The method of controlling a liquid ejection apparatus according to claim 13, wherein the notification unit is caused to notify the user of information on a type of liquid with which to replenish the liquid storage container as the information on replenishment of the liquid storage container with a liquid.

17. The method of controlling a liquid ejection apparatus according to claim 16, wherein the notification unit is further caused to also notify the user of information prompting replenishment of the liquid storage container with a same type of liquid as the liquid to be ejected from the liquid ejection unit.

18. The method of controlling a liquid ejection apparatus according to claim 16, wherein the notification unit is caused to notify the user of information prompting replenishment of the liquid storage container with water.

19. A liquid ejection apparatus comprising:

a liquid ejection unit configured to eject a liquid;

a liquid storage container comprising a replenishment port through which to replenish the liquid storage container with a liquid and a member which closes and opens the replenishment port, the liquid storage container being replenishable with the liquid to be supplied to the liquid ejection unit from the replenishment port;

a notification unit configured to notify a user of information; and a control unit configured to control the notification unit, wherein in a case where a time elapsed since a previous liquid ejection by the liquid ejection unit is a predetermined time or longer, the control unit causes the notification unit to notify the user of information on replenishment of the liquid storage container with water.

* * * * *